United States Patent [19]

van Zweeden

[11] Patent Number: 4,800,801

[45] Date of Patent: Jan. 31, 1989

[54] PUMP

[75] Inventor: Adriaan van Zweeden, Rijsenhout, Netherlands

[73] Assignee: Multinorm B.V., Nieuw-Vennep, Netherlands

[21] Appl. No.: 860,026

[22] Filed: May 6, 1986

[30] Foreign Application Priority Data

May 8, 1985 [NL] Netherlands ..... 8501315

[51] Int. Cl.[4] ..... F04B 1/28; F16J 9/28; F16J 7/00; F16J 1/14

[52] U.S. Cl. ..... 92/12.2; 92/248; 92/249; 92/258; 417/269

[58] Field of Search ..... 417/269, 454; 92/248, 92/257, 258, 129, 12.1; 91/503, 506

[56] References Cited

U.S. PATENT DOCUMENTS

| | | | |
|---|---|---|---|
| 2,146,231 | 2/1939 | Logan | 417/273 |
| 3,292,554 | 12/1966 | Hessler | 417/269 |
| 3,828,657 | 8/1974 | Neumann | 92/258 |
| 4,004,499 | 1/1977 | Beck | 92/257 |
| 4,077,269 | 3/1978 | Hodgkinson | 417/269 |
| 4,188,859 | 2/1980 | Van Wagenen | 417/269 |
| 4,197,787 | 4/1980 | Schneider | 92/129 |
| 4,342,544 | 8/1982 | Pere | 417/269 |
| 4,433,596 | 2/1984 | Scalzo | 91/506 |
| 4,491,057 | 1/1985 | Ziegler | 91/503 |
| 4,545,732 | 10/1985 | Oberdorfer | 417/454 |

FOREIGN PATENT DOCUMENTS

| | | | |
|---|---|---|---|
| 3347307 | 7/1985 | Fed. Rep. of Germany | 417/269 |
| 2124823 | 9/1971 | France | 92/248 |
| 162780 | 9/1983 | Japan | 417/244 |
| 798350 | 1/1981 | U.S.S.R. | 417/269 |
| 781635 | 8/1957 | United Kingdom | 417/269 |

*Primary Examiner*—William L. Freeh
*Attorney, Agent, or Firm*—John P. Snyder

[57] ABSTRACT

A swash plate pump includes a housing and cylinders arranged in a circular pattern around the drive shaft. Piston rods are pivotally connected at one end to the swash plate and mechanism surrounding the drive shaft and axially slidable along it controls the angle of the swash plate. The opposite end of each piston rods is fixed to a piston. In one embodiment, each piston rod is locally reduced in cross-sectional area adjacent its piston to compensate for disparity in arcuate motions of the opposite ends of the piston rod and in another embodiment, the cylinders are mounted in ball joints in the housing to compensate the disparity. One end of the housing may be formed as a manifold and double seals are provided between the compression side and the drive side of the pump.

16 Claims, 4 Drawing Sheets

PUMP

Figure 1:
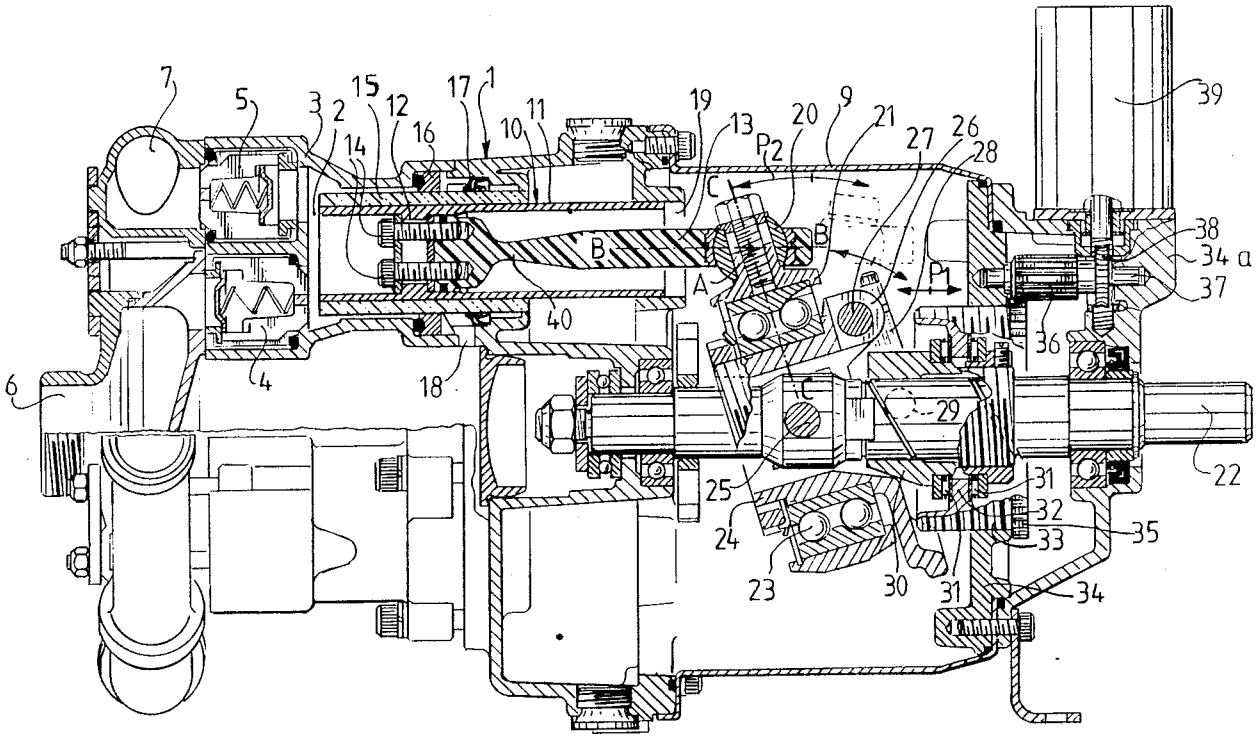

This invention relates to an apparatus for pumping a fluid, which apparatus consists principally of a housing with two or more parallel cylindrical pump chambers, in each of which a piston is reciprocally moveable, which piston is connected via a piston-rod to a rocker-piece mounted on a parallel to the cylinders, rotatably journalled in the housing driving-shaft.

Devices of the type described in the commencement, also called axial reciprocal pumps with stationary pistons and stationary rocker-piece, are usually made with a piston-rod equipped with two ball joints, that is to say, the piston-rod being at one end connected thereby to the piston, and at the piston-rod being connected at the other end thereby to the rocker-piece. The recurrent problem with this arrangement is that such ball joints acquire, after a while, a degree of play which reduces the operational life. Moreover, particularly in the case of small pumping apparatus, a construction of the stated kind is expensive and difficult to realize.

The invention has for its aim to eliminate the above-mentioned difficulties and, to that end, provides an apparatus which is distinguished in that the piston-rod is connected at one end fixedly to the piston and at the other end movably to the rocker-piece, the piston rod being at the piston end tiltable around a transverse axis with respect to the housing.

In one embodiment the transversely directed tilting axis is formed by the piston-rod displaying a reduction in cross-section, locally when seen in a longitudinal plane, whereby the piston-rod itself operates as a hinge as a consequence of the piston-rod being flexible at the local narrowing.

According to another embodiment, in the pump chamber a cylindrical shell is mounted tiltably around the transverse axis, the piston being fed reciprocally movably into the cylindrical shell. The piston-rod is itself hereby rigidly made, the required freedom of movement being obtained through the tiltability of the shell fitted around the piston.

A further problem with an apparatus of the type described in the commencement arises at the seal between the compression side and the drive side of the pump chamber. The seal is extremely important, particularly during the pumping of contaminated substances, in order to keep these substances out of the oil-lubricated drive side even after a long period of operation.

The invention therefore proposes providing an apparatus which is distinguished in that there is fitted around the piston a bush of a hard material such as ceramic material, said bush cooperating with one or more sealing means.

In the one embodiment, the bush can be fixed to the piston, the bush being guided in two sealing rings mounted in the housing with a distance between them. Owing to the bush of hard material, wear will be limited to a minimum, particularly if the sealing rings are of the conventional soft type.

In order to improve the guidance of the piston with the bush of hard material fitted firmly around it, the piston can moreover be made with a guide-bush which extends on the piston-rod side beyond the bush of hard material. This guide-bush can easily be journalled in the housing on the oil-lubricated side thereof, without the occurrence of problems due to wear.

In another embodiment, the bush of hard material is made as an inner lining of the shell mounted tiltably in the housing. In this embodiment, a sealing ring can be fitted in a conventional manner between the bush and the piston.

In order to obtain an adequate seal between the tiltable shell and the housing, there are preferably two sealing means, at a distance from each other, fitted between the shell and the housing.

In both embodiments there is preferably a drain aperture situated between the two sealing means, so that any possible leakage, either from the drive side or from the compression side, can be removed via this drain without the leaked liquid reaching the wrong side.

For obtaining an adjustable pump, that is to say with an adjustable pumping yield, the rocker piece according to the invention is journalled on a carrier connected hingeably to the driving shaft, which carrier can be set at a predetermined angle with respect to the shaft by adjusting means.

The adjusting means are, in one embodiment, made as a sliding sleeve, slidably operated by an adjusting motor and fitted coaxially around the driving shaft.

If the pumping apparatus is provided for each pump chamber with an inlet and outlet valve connected to an intake and an outlet respectively, then the invention further proposes, in order to limit the number of components, making the outlet as a uniform pipe piece, the pipe pieces being connectable to one another, directly or via a coupling pipe. An annular common outlet conduit is formed hereby which is suitable for application with an arbitrary number of pump chambers. This contributes to a simpler and less expensive construction of the pumping apparatus.

The above-mentioned and other characteristics of the invention are further explained below by reference to two embodiments.

Figure 2:
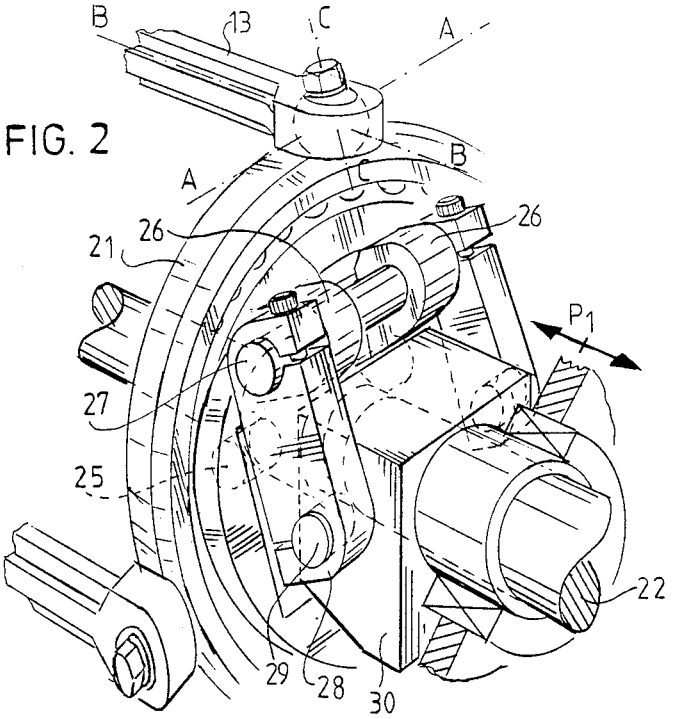
Figure 4:
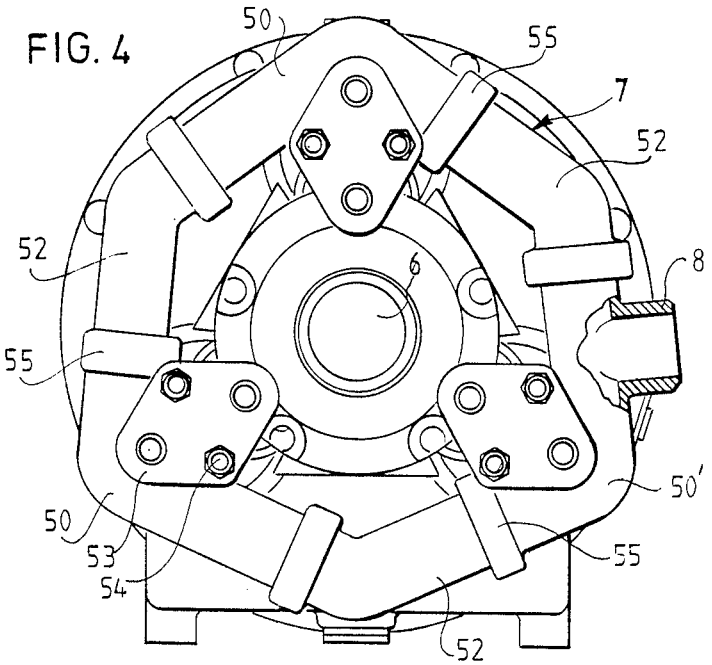
Figure 3:
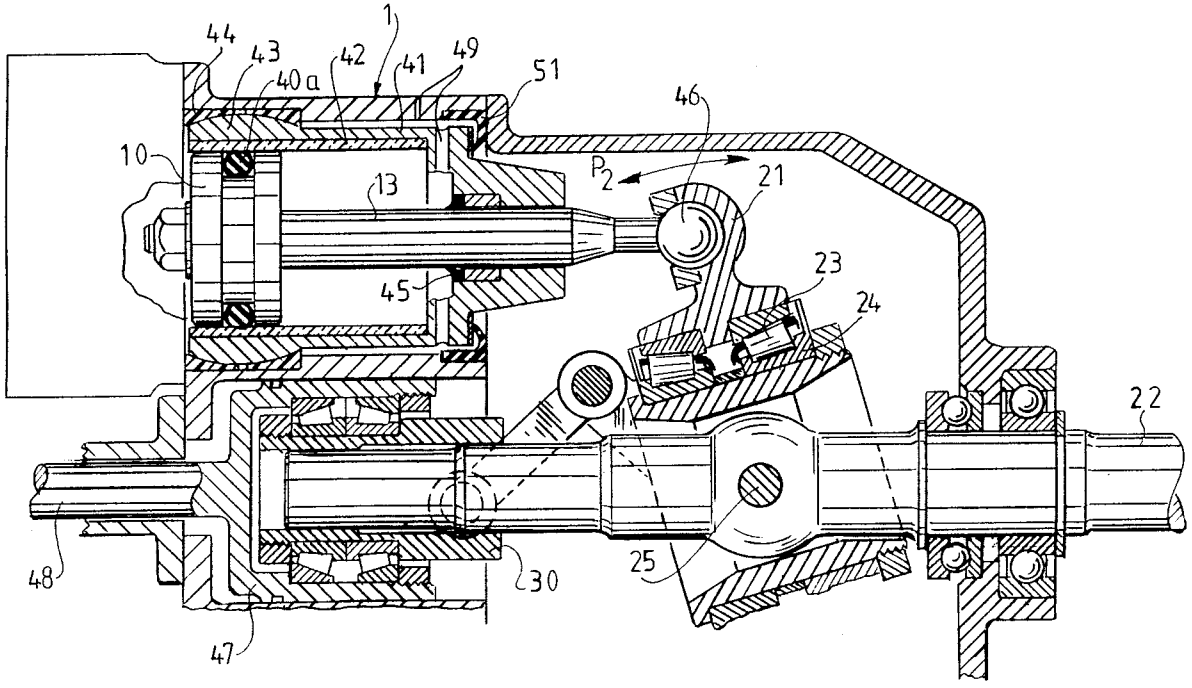
Figure 5:
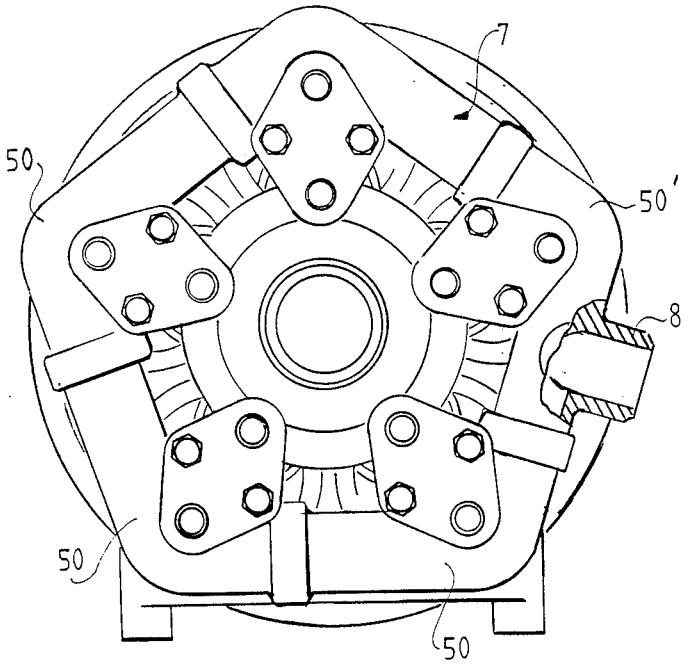

In the drawings:

FIG. 1 shows an axial longitudinal section of a first embodiment of the apparatus according to the invention, FIG. 2 shows a perspective view of the rocker-piece in the apparatus of FIG. 1, on an enlarged scale, FIG. 3 shows an axial longitudinal section corresponding to FIG. 1 of a second embodiment of the pumping apparatus according to the invention, FIGS. 4 and 5 show a left side-view of the apparatus of FIG. 1 with three and five pump-chambers respectively.

The pump drawn in FIG. 1 is made with a housing in which in central portion 1 there are situated a number of circularly arranged pump-chambers. The number can be arbitrary, for example three (FIG. 4) or five (FIG. 5).

On the left in FIG. 1 there is fastened to central portion 1 for each pump-chamber 2 a valve house 3, which cooperates with pistons 10 and in which the inlet and outlet valve combinations belonging to each pump-chamber, 4 and 5 respectively, are mounted. The multiplicity of inlet valves 4 is connected to central intake stub 6 for the supply of the medium, outlet valves 5 being joined together by outlet ring-conduit 7 which will be described further below, which ring-conduit has a common outlet stub 8.

On the right of central portion 1 there is fastened housing part 9 wherein the drive and transmission are mounted for reciprocally movable in pump-chambers 2 pistons 10.

The pistons shown in FIG. 1 consist of cylindrical metal jacket 11 which is provided with transverse partition 12, to which piston-rod 13 is fastened by means of bolts 14. Around jacket 11 there is fixed bush 15 of ceramic material. This bush 15 is guided through two seals 16, 17, such that pump-chamber 2 is closed off in the direction of the tramsmission part. In the annular space formed between seals 16, 17 there is situated a drainage opening 18, through which any leaked fluid from either the pump chamber or the transmission space can be discharged.

It is clearly apparent from FIG. 1 that jacket 11 of piston 10 projects on the transmission side well past bush 15, whereby it is possible to slidably guide this jacket 11 in through-drilling 19 in a transverse partition of central portion 1.

Piston-rod 13 is journalled at the end opposite to piston 10 on pivot 20 of rocker-piece 21. The pivot permits a rotational movement of piston-rod 13 with respect to rocker-piece 21 around two intersecting axes (see also FIG. 2), one of which A—A lies in the plane of the rocker piece perpendicular to the longitudinal axis B-B of the piston-rod, and the other C—C lies in this same plane and through the centre-line of central driving shaft 22, to be described further below. The hinge does not permit any rotation in the direction of longitudinal axis B—B of the piston-rod.

Rocker-piece 21 is supported via ball-bearing 23 on carrier 24, which is fitted pivotably on two diametrically oppositely disposed pivot-pins 25 which are fastened perpendicularly to drive shaft 22.

Carrier 24 is fashioned at its top end with pair of eyes 26 (see also FIG. 2) through which is passed pivot-pin 29, on the extremities of which pivot arm 28 is fastened. The other end of pivot arm 28 is rotatably journalled on pivot-pin 29 of axially along drive-shaft 22 slidable sliding-piece 30 (see arrow P1). Sliding-piece 30 carries along its outer circumference two needle-roller bearings 31, between which inner flange 32 of threaded sleeve 33 is mounted. Threaded sleeve 33 has a threaded section on its outside which cooperates with a threaded hole in end wall 34 of the righthand housing portion 9. Threaded sleeve 33 is on the right of end wall 34 fashioned with gear-wheel 35, which cooperates with pinion 36 which is fastened to rotatably journalled in end wall 34 and end-cap 34*a* shaft 37. This shaft 37 is moreover provided with worm-gear transmission 38, of which the worm can be made to rotate by means of adjuster motor 39.

Finally, it should be mentioned that central drive shaft 22 can be driven via the right-hand connection stub by a motor and transmission (not shown). It should be noted here that central driving shaft 22 can be rotatably journalled in any arbitrary way in end-cap 34*a* and central housing portion 1, by means of ball-bearings or suchlike.

According to a main characteristic of the invention, piston-rod 13 is when seen in longitudinal section (see FIG. 1) locally narrowed in cross-section (see at 40), whereby a bending point occurs for obtaining the required freedom of movement for the otherwise rigidly connected to piston 10 piston-rod 13, which will be further explained below.

The pump according to the invention works as follows:

On driving shaft 22 being caused to rotate, carrier 24 is thereby rotated around the driving shaft, which on account of the slanting position in FIG. 1 causes rocker-piece 21 to rock back and forth in the direction of arrow P2. Point A, the centre-point of pivot 20, and consequently the right-hand portion of piston-rod 13, will move through an arc-shaped trajectory. This motion is transmitted to piston 10, which undergoes a rectilinear reciprocating motion owing to the guidance at the right-hand end of jacket 11 or at seals 16, 17. The arc-shaped motion of the right-hand portion of piston-rod 13 can take place owing to the narrowed flexible part 40 in piston-rod 13.

Owing to the reciprocating motion of piston 10 in pump-chamber 2, fluid can be pumped in the usual manner from inlet stub 6 through inlet valve 4 to outlet valve 5, outlet channel 7 and discharge stub 8. It must be emphasized that the piston shown in FIG. 1 is fitted in multiple positions in housing 1, which pistons acquire the above-described reciprocating motion from rocker-piece 21, whereby a multiplicity of pistons can be set into an oscillatory pumping motion with the one drive shaft 22.

The adjustment of the pump-stroke and thus the yield of the pump can take place by the operation of adjuster motor 39, which causes screwed sleeve 33 to turn via worm-gear transmission 38 and gear-wheel transmission 36, 35. This turning causes an axial displacement with respect to pump-housing portion 9 or to drive shaft 22, whereby slide-piece 30 is also displaced through needle-roller bearings 31. The axial displacement of slide-piece 30 causes a change in the position of carrier 24 as a consequence of the hinged coupling by means of coupling arm 28 (see also FIG. 2). The change in angle of carrying part 24 with respect to the longitudinal axis of driving shaft 22 causes a greater or lesser arc through which point A is reciprocally moved, as a result of which the piston-stroke of piston 10 is determined.

During the above-described pumping action there remains a good seal around the ceramic piston-bush 15 which cooperates with relatively soft sealing rings 16, 17. Any possible leakage of pumped fluid from pump-chamber 2 past seal 16, or of lubricant from the driving side past seal 17, can be discharged via opening 18. Wear is limited to a minimum by the combination of hard ceramic bush 15 and soft seals 16, 17, by which means a long operational life is ensured. Guidance of piston 10 is nevertheless assured owing to the long jacket 11, extending towards the right. A simple construction is ensured by the flexible piston-rod 13, whereby a bearing at the junction of piston-rod and piston becomes unnecessary.

FIG. 3 shows an alternative embodiment in which the same components are labelled with the same identification numbers. The difference lies in the construction of tiltable piston-rod 13, which in this embodiment is rigidly fashioned over its whole length. Piston-rod 13 is fixed by means of a bolted connection to piston 10, which is here provided in the usual manner with O-ring 40*a* as a seal. The piston is reciprocally moveable in cylinder 41 which is fitted on its inner wall with a hard ceramic liner 42. Cylinder 41 is provided on the left with spherical bearing surface 43 which cooperates with bearing seat 44, which is fixed in central housing part 1. Piston-rod 13 is bushed in the conventional manner through the closed base of the cylinder, whereby sealing ring 45 is operative along piston rod 13.

The right-hand end of the piston-rod is connected via ball-joint 46 to rocker-piece 21, which is supported by bearing 23 on carrier 24. Carrier 24 is again tiltable around pivot-pin 25 with respect to central drive-shaft 22, the degree of tilting being adjustable by means of adjuster-sleeve 30, on the left in FIG. 3. The adjuster-sleeve is again slidable by means of plunger 47, axially slidably mounted in central housing part 1, which plunger is displaceable via control-rod 48.

The operation of this embodiment is as follows. On rotation of driving shaft 22, rocker-piece 21 describes an arc-shaped trajectory P2 in the way explained above, whereby ball 46 also follows that trajectory. As a consequence of the rigid connection of piston-rod 13 to piston 10, the piston in this embodiment also undergoes a tilting motion, which is made possible by the complying rocking motion of cylinder 41, owing to the spherical bearing surface of part 43 in bearing cup 44.

Here also a double seal is provided between the compression side and the drive side of the pump. Possible fluid leakage past seal 40 can be carried away to the exterior via drainage channels 49. Channels 49 are in mutual communication via the space between the outer wall of cylinder-jacekt 41 and the inner wall of housing-part 1. This space is therefore closed off on the right side by extra seal 51. Possible lubricant leakage past seal 45 is discharged via the same drainage channels 49.

Wear of the cylinder-jacket is limited owing to the application of hard ceramic inner liner 42, which cooperates with the relatively soft sealing ring 40.

FIGS. 4 and 5 each show a head end of a pump, with three and five pump-chambers respectively.

As was stated above, inlet channel 6 is mounted centrally and the outlet channel passes around it in circular fashion. Ring 7 consists of a multiplicity of identically-shaped segments 50, each provided at one end with widened flange 51 in which, for the pump with three pump-chambers, a connecting pipe-piece 52 can be fitted. Only one segment-piece 50′ is provided with a discharge stub 8.

FIG. 5 shows the embodiment in which five pump-chambers are applied, and for which the same segments 50 and 50′ are usable. Connecting pieces 52 are here unnecessary.

Segments 50 and central inlet channel 6 are fastened onto valve-house 3 by means of clamping plates 53 and bolts 54. Also by this means, simple assembling of the pump is achieved.

The invention is not limited to the above-described embodiments.

I claim:

1. A fluid pump comprising the combination of a housing and a rotatable drive shaft journalled in the housing and defining a drive axis, a plurality of cylindrical pump chambers grouped around the drive axis along a circular path within a plane perpendicular to the drive axis with the axes of the chambers being generally parallel to the drive axis, a piston reciprocably received in each chamber for reciprocation along the axis of its associated chamber, swash plate means carried by the drive shaft for rotation therewith, an integral piston rod for each piston, means for rigidly connecting one end of each piston rod to its associated piston so as to extend in unguided, cantilever fashion therefrom toward and to the swash plate means, complementary ball joint means connecting each piston rod at the opposite end thereof to the swash plate means for oscillating such opposite end of each piston rod along a fixed arcuate drive path in a plane containing the drive axis as the drive shaft is rotated so that each such opposite end of the piston rod describes a fixed arcuate driving path which is different from linear reciprocation of its associated piston parallel to the drive axis so that the entire unguided portion of the piston rod from its rigid connection at the one end of the piston rod toward and to the swash plate means is free to oscillate cyclically in a plane perpendicular to the drive axis, and compensating means for compensating such cyclic oscillation of the unguided portion of each piston rod, including means surrounding the drive shaft and axially slidable therealong and actuating means for effecting such sliding to vary the angle of the swash plate means.

2. A fluid pump as defined in claim 1 wherein the compensating means comprises localized cross-sectional area reduction of each piston rod adjacent the one end thereof.

3. A fluid pump as defined in claim 1 wherein the compensating means comprises ball joint means mounting each chamber in the housing.

4. A fluid pump as defined in claim 1 wherein each piston is of hollow, sleeve-like form guided within the housing such that its axis is held parallel to the drive axis.

5. A fluid pump as defined in claim 1 wherein each pump chamber is a cylinder mounted tiltably about its axis, in which cylinder its piston is reciprocally movably bushed.

6. A fluid pump as defined in claim 5 each bush is embodied as the inner lining of its cylinder mounted tiltably in the housing.

7. A fluid pump as claimed in claim 6 including double sealing means provided between the compression side and the drive side of the pump.

8. A fluid pump as claimed in claim 7 wherein a drainage opening is located between each of the double sealing means.

9. A fluid pump as claimed in claim 1 wherein around each piston a bush of hard material cooperating with one or more sealing means is fitted.

10. A fluid pump as claimed in claim 9 wherein each bush is fixed to its piston and is guided in two seals mounted in the housing at a distance from each other.

11. A fluid pump as claimed in claim 10 characterized in that each piston displays at its piston-rod side a guidance jacket extending past the bush of hard material.

12. A fluid pump comprising the combination of a housing and a rotatable drive shaft journalled in the housing and defining a drive axis, a plurality of cylindrical pump chambers grouped around the drive axis along a circular path within a plane perpendicular to the drive axis with the axes of the chambers being generally parallel to the drive axis, a piston reciprocably received in each chamber for reciprocation along the axis of its associated chamber, swash plate means carried by the drive shaft for rotation therewith, an integral piston rod for each piston, means for rigidly connecting one end of each piston rod to its associated piston so as to extend in unguided, cantilever fashion therefrom toward and to the swash plate means, complementary ball joint means connecting each piston rod at the opposite end thereof to the swash plate means for oscillating such opposite end of each piston rod along a fixed arcuate drive path in a plane containing the drive axis as the drive shaft is rotated so that each such opposite end of the piston rod describes a fixed arcuate driving path which is different from linear reciprocation of its associated piston parallel to the drive axis so that the entire unguided portion of the piston rod from its rigid connection at the one end of the piston rod toward and to the swash plate means is free to oscillate cyclically in a plane perpendicular to the drive axis, and compensating means for compensating such cyclic oscillation of the unguided portion of each piston rod, each piston being formed of hard material of sleeve-like form, one end of each piston being supported in the housing and projecting therefrom and there being further housing support intermediate the ends of each piston.

13. A fluid pump as defined in claim 12 including a seal surrounding each piston adjacent the one end thereof and a second seal, spaced from the first seal, adjacent the further housing support and there being a drainage passage between the first and second seals.

14. A fluid pump comprising the combination of a hollow housing having opposite ends, one of the ends being closed to define a drive sump and a manifold assembly closing the other end of the housing, a rotatable drive shaft extending into the housing through the one end thereof and terminating adjacent the other end of the housing and journalled in the housing to define a drive axis, a plurality of cylindrical pump chambers grouped around the drive axis along a circular path within a plane perpendicular to the drive axis, each chamber being of sleeve-like form and having an end positioned beyond the drive shaft and covered at the other end of the housing by the manifold assembly, a piston reciprocably received in each chamber for reciprocation along the axis of its associated chamber, swash plate means within the sump and carried by the drive shaft for rotation therewith, an integral piston rod for each piston, means for rigidly connecting one end of each piston rod to its associated piston so as to extend in unguided, cantilever fashion therefrom toward and to the swash plate means, complementary ball joint means connecting each piston rod at the opposite end thereof to the swash plate means for oscillating such opposite end of each piston rod along a fixed arcuate drive path in a plane containing the drive axis as the drive shaft is rotated so that each such opposite end of the piston rod follows the fixed arcuate drive path which is different from linear reciprocation of its associated piston parallel to the drive axis so that the unguided portion of the piston rod cyclically oscillates in a plane perpendicular to the drive axis, and compensating means for compensating such cyclic oscillation of the unguided portion of each piston rod.

15. A fluid pump as defined in claim 14 wherein the manifold assembly is of two piece construction comprising a valving section mating with the opposite end of the housing and a common inlet/outlet section mating with the valving section.

16. A fluid pump as defined in claim 15 wherein the inlet/outlet section includes a central inlet portion and a circumferential outlet portion.

* * * * *